US006474035B1

(12) United States Patent
Fara

(10) Patent No.: US 6,474,035 B1
(45) Date of Patent: Nov. 5, 2002

(54) CONTAINMENT APPARATUS FOR REMOVING WINDOWS AND WINDOW FRAMES

(75) Inventor: Mark C. Fara, Monrovia, MD (US)

(73) Assignee: Fara Containment Systems, LLC, Baltimore, MD (US)

( * ) Notice: Subject to any disclaimer, the term of this patent is extended or adjusted under 35 U.S.C. 154(b) by 0 days.

(21) Appl. No.: 09/898,176

(22) Filed: Jul. 3, 2001

Related U.S. Application Data

(60) Provisional application No. 60/290,887, filed on May 15, 2001.

(51) Int. Cl.[7] ..... E04G 21/24

(52) U.S. Cl. ..... 52/506.05; 52/202; 52/127.2; 52/DIG. 12; 52/745.15; 52/749.1; 52/DIG. 1

(58) Field of Search ..... 52/202, 203, 127.2, 52/DIG. 12

(56) References Cited

U.S. PATENT DOCUMENTS 4,193,232 A * 3/1980 Almsted et al. ..... 52/98
4,221,091 A 9/1980 Ganse et al. ..... 52/202
4,671,031 A * 6/1987 Intengan ..... 52/203
4,926,722 A 5/1990 Sorensen et al. ..... 81/487
5,009,134 A 4/1991 Sorensen et al. ..... 81/487
5,022,137 A 6/1991 Sorensen et al. ..... 29/559
5,201,152 A 4/1993 Heffner ..... 52/64
5,457,922 A * 10/1995 Fara ..... 52/202
5,669,191 A * 9/1997 Weaver ..... 52/202
5,685,112 A * 11/1997 Fara ..... 52/202
6,029,407 A * 2/2000 Schillero, Jr. ..... 52/127.2

* cited by examiner

*Primary Examiner*—Carl D. Friedman
*Assistant Examiner*—Basil Katcheves
(74) *Attorney, Agent, or Firm*—Leonard Bloom; Robert M. Gamson

(57) ABSTRACT

A containment apparatus for removal of a window/window frame from within the wall of a building. The containment apparatus has a rigid member with a peripheral gasket. An adjustable supporting member, which is connected to the rigid member, extends angularly to the ceiling above the rigid member. The bottom end of the rigid member is braced to secure the rigid member in place.

35 Claims, 11 Drawing Sheets

CONTAINMENT APPARATUS FOR REMOVING WINDOWS AND WINDOW FRAMES

This application is related to provisional patent application Serial No. 60/290,887, filed May 15, 2001.

BACKGROUND OF THE INVENTION

The invention relates to apparatus and methods used to rapidly remove structural parts of a building with minimum disturbance of the area surrounding the building or the inhabited living areas of the building.

There is a need in the art for structurally modifying inhabited building structures without substantial inconvenience and disruption to the normal activity of the residents of the building.

When buildings are renovated or repairs are made to windows and/or window frames, much dirt, dust and other contamination is produced. This is a major inconvenience and, if lead-based paint is present, can become a hazard which requires special handling.

Prior art U.S. patents show the state of the art.

Almstead et al in U.S. Pat. No. 4,193,232 disclose a window cap for sealing a window to conserve energy. The device is pan-like with edges which can be attached to the building structure to keep cold air from entering the building through the windows.

U.S. Pat. No. 4,221,091 to Ganse et al discloses an insulation system for windows with the insulation panels placed in brackets on the inside walls.

A containment device for contaminated building demolition is taught by Heffner in U.S. Pat. No. 5,201,152. The Heffner containment device is designed to surround an entire building. The device is made of a rigid steel frame, covered with a flexible fabric or plastic sheet material, and moves on railroad tracks from place to place.

In U.S. Pat. Nos. 5,457,922 and 5,685,112, Fara (the present inventor) teaches a containment box which is mounted interiorly in a building to fit against the polluted structure and prevent contamination of the interior of the building when the polluted structure is removed from outside of the building.

The only prior art which discloses a containment system which surround a work area attached to a floor and ceiling of a room and has a seal are the Fara patents. However, the containment box is large and requires time to properly mount and seal.

BRIEF SUMMARY OF THE INVENTION

The invention herein disclosed addresses the problem of dust, dirt, pollution and inconvenience to residents of homes and offices being remodeled.

The containment box of U.S. Pat. Nos. 5,457,922 and 5,685,112 facilitates making the structural modifications to buildings and is particularly useful in expediting the removal of windows and window frames of existing buildings in an environmentally safe manner. The building living area can remain occupied while modifications are being made.

The containment box has a periphery seal to provide an airtight seal. A jackscrew at the top of the box and a floor pad are used to position the containment box with respect to the polluted structure to be removed. The patented Fara containment box, while a substantial improvement in the art, is relatively large and heavy and requires some time to properly install and move from one location to another.

It is an object of the present invention to provide a relatively lightweight apparatus which is easily mounted on the interior of a building to form a seal around a structure so that the structure may be removed from the outside of the building with minimum inconvenience to the inside of the building.

In accordance with teachings of the present invention, there is disclosed in a building including an interior having an upper surface and a lower surface, vertically spaced apart, and further having a structure in a wall disposed vertically between the upper surface and the lower surface, an apparatus for removing the structure from externally of the building. The apparatus has a single unitary planar rigid member adapted to fit against a vertical surface within the interior of the building and to surround the structure in a substantially airtight relationship, thereby precluding dust and debris from entering the interior of the building as the structure is removed from externally of the building. The planar rigid member has a top end and a bottom end. The bottom end is supported on a bottom portion of the structure. An adjustable supporting member is connected to the rigid member and extends angularly to the upper surface above the top end of the planar rigid member. A first sealing gasket is disposed peripherally around the rigid member and surrounds the structure, forming the airtight relationship with the vertical surface. A second sealing gasket is disposed on the bottom end of the rigid member forming the airtight relationship with the bottom portion of the structure.

In further accordance with the teachings of the present invention, there is disclosed in a building including an interior having a floor and a ceiling, and further having a structure in a wall disposed vertically between the floor and ceiling, an apparatus for removing the structure from externally of the building. The apparatus has a single unitary planar rigid member adapted to fit against a vertical surface within the interior of the building and to surround the structure in a substantially airtight relationship, thereby precluding dust and debris from entering the interior of the building as the structure is removed from externally of the building. An adjustable clamp means is attached to a bottom end of the rigid member to prevent lateral movement of the bottom end of the rigid member and to secure the bottom end of the rigid member to the structure in the substantially airtight relationship. An adjustable supporting member is connected to the rigid member and extends angularly to a surface above a top end of the rigid member.

There is further disclosed a containment apparatus for the removal of a window and/or window frame within the wall of a building. A substantially-flat sheet is formed from a relatively high-impact plastic material. A peripheral gasket is provided for sealing engagement with a vertical surface of the building from the inside thereof, such that the sheet covers the window or window frame. A means is provided for removably retaining the sheet rigidly against the vertical surface of the building while the window or window frame is being removed externally of the building, thereby preventing dust or debris from entering into the building during removal of the window or window frame.

Additionally, there is disclosed a containment apparatus for the removal of a window and/or window frame within the wall of a building. A member is disposed against a vertical surface from the inside of the building in sealing engagement therewith and covering the window and/or window frame. A jack is carried by the member for rigidly retaining the member against vertical surface within the building, such that the window and/or window frame may be removed from the outside of the building without dust or debris entering into the interior of the building. The jack is angled with respect to the member, such that the jack exerts a force having a vertical component for retaining the jack within the building and further having a horizontal component for pressing the member against the vertical surface within the building.

Furthermore, there is disclosed, in a building having a room having a ceiling and a window mounted in an opening between an exterior wall and an interior wall of the building wherein the window is blown out due to weather or is otherwise damaged, a temporary containment apparatus to enclose the opening. A substantially flat rigid member has a peripheral gasket for sealing engagement with the interior wall of the building wherein the rigid member completely covers the opening in the interior wall. The rigid member has a top end and a bottom end. An adjustable clamping means is connected to the bottom end of the rigid member. The clamping means is disposed in the opening between the exterior wall and the interior wall of the building to secure the rigid member.

In another aspect, there is disclosed the method of removing a structure from a wall in a building. A planar rigid member is provided having a gasketing means formed peripherally thereabout. The planar rigid member is removably installed within the building against a vertical surface. A bottom end of the planar rigid member is supported on a bottom portion of the structure being removed. The gasketing means on the planar rigid member contacts the vertical surface surrounding said structure in a substantially airtight manner, thereby confining any dust and debris and preventing the dust and debris from entering the building. The structure is removed while working from outside of the building, and the planar rigid member is removed for subsequent reuse thereof.

These and other objects of the present invention will become apparent from a reading of the following specification taken in conjunction with the enclosed drawings.

BRIEF DESCRIPTION OF THE DRAWINGS

FIG. 11 shows the worker bringing the apparatus to the interior of the building where the structure is to be removed.

FIG. 12 shows the lower end of the apparatus disposed on the interior window stool (or sill).

FIG. 13 shows the apparatus disposed interiorly against the wall to surround the structure.

FIG. 14 shows the coarse adjustment of the jack system to support the apparatus against the ceiling.

FIG. 15 shows the fine adjustment of the jack system.

FIG. 16 shows the apparatus installed and the structure being removed externally of the building.

DESCRIPTION OF THE PREFERRED EMBODIMENTS

Figure 2:
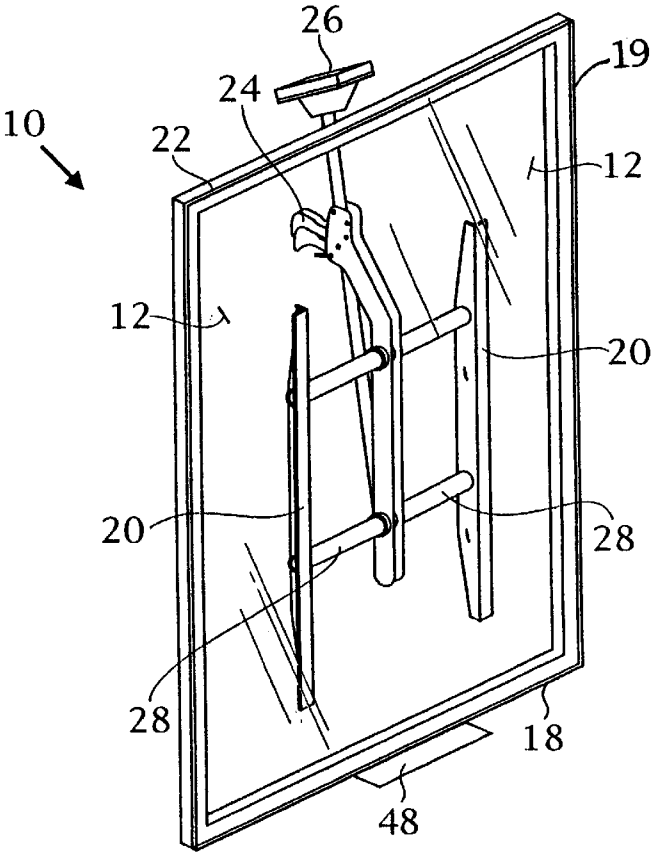
FIG. 2 is a perspective view of the apparatus of the present invention viewed from the face oriented toward the structure in the wall.

Referring now to FIGS. 1–5, the containment apparatus 10 of the present invention is a single unitary planar rigid member 12, preferably formed from a high-impact transparent plastic material such as Lexan® or Lucite®. A first gasket means 14 is disposed peripherally about a first face of the rigid member 12. A second gasket or sealing means 16 is disposed on the bottom end 18 of the rigid member 12. The gasket means 14, 16 may be any compressible material but preferably is a plastic foam with an adhesive backing which is economical and is easily mounted or moved on the rigid member wherever needed. Alternately, the gasket means may be a tube formed from a compressible material. The first gasket means 14 is a continuous seal around the rigid member 12. The second gasket means 16 extends the entire length of the bottom end 18 of the rigid member 12. The gasket means 14, 16 may be retained on the rigid member 12 by a channel 19 in which the peripheral edges of the rigid member and the gasket are received. The channel may be C-shaped or U-shaped and may be bolted to, or otherwise retained about, the rigid member.

A vertical brace 20 is mounted on a second face of the planar rigid member 12 opposite from the first face on which the first gasketing means 14 is disposed. Preferably, the vertical brace 20 is connected at approximately the midpoint of the rigid member 12 and extends towards the bottom end 18 and the top end 22 of the planar rigid member 12. In a preferred embodiment, the vertical brace 20 is a pair of spaced-apart right angled members having one side of each angled member connected to the planar rigid member 12 by nuts and bolts, adhesive or other securing means known to persons skilled in the art.

An adjustable supporting member 24 (a jack system) is connected to the vertical brace 20 and is extendable to an upper surface such as the ceiling 36 of the room or any projection which is above the top of the rigid member 12. The room has a wall 34 in which there is a structure which is to be removed. A top pad 26 is connected to the adjustable supporting member 24 by a jointed connection 25 to assure firm contact with the ceiling or upper surface irrespective of any angular differences between the ceiling and the vertical brace 20. Preferably, the top pad 26 has a cushioned surface which contacts the ceiling.

Figure 4:
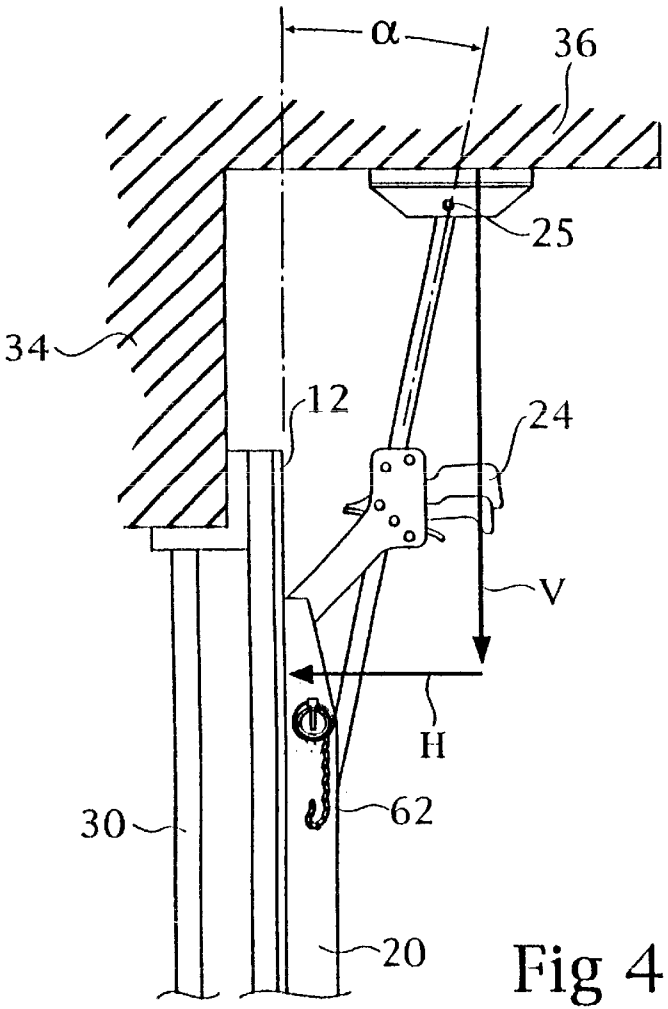
FIG. 4 is a side view of the apparatus showing force components of the jack system.

An important feature of the present invention is that the adjustable supporting member 24 is angled with respect to the rigid member 12. In one embodiment, the angle a (see FIG. 4) is approximately 10°–14° and, preferably, 12°. At this angle the jack system 24 is firmly in contact with the upper surface (ceiling) 36 and exerts a force on the planar rigid member 12 as shown in FIG. 4. The force includes a horizontal force component H exerted against rigid member 12 and a vertical force component V which maintains apparatus 10 in place within the building. The horizontal force component H reduces any tendency for the rigid member 12 to bow, which would otherwise weaken the peripheral seal of the first gasket means 14.

It is further preferred that the jack system 24 have a "coarse" adjustment and a "fine" adjustment to facilitate engagement of the rigid member with the building structure. The coarse adjustment provides the workman with the ability to rapidly move the top pad 26 toward the ceiling 36 and the fine adjustment provides the workman the ability to adjust the force directed against the ceiling 36 to assure a secure placement of the rigid member 12 with satisfactory peripheral seal and without damaging the ceiling 36. A quick release means is also provided to facilitate removal of the containment system. The rigid member 12 may be secured at a desired height between a lower surface such as the floor and the upper surface (ceiling).

Figure 6:
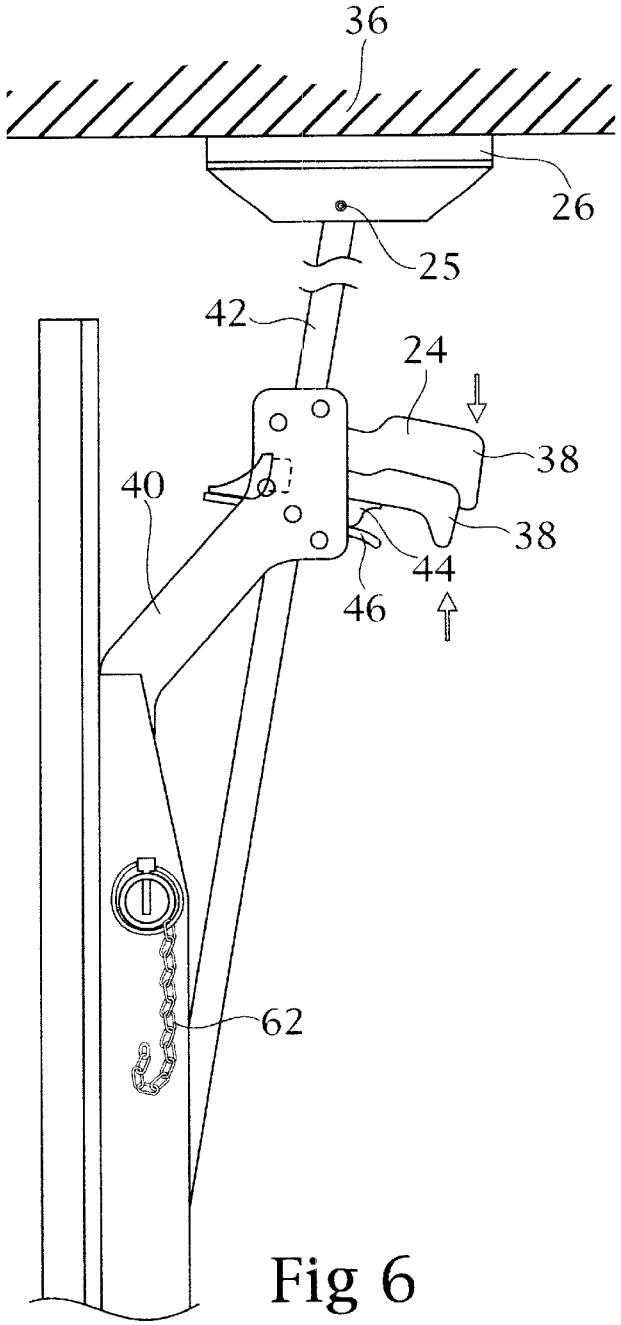
FIG. 6 is an enlarged view of the jack system.
Figure 7:
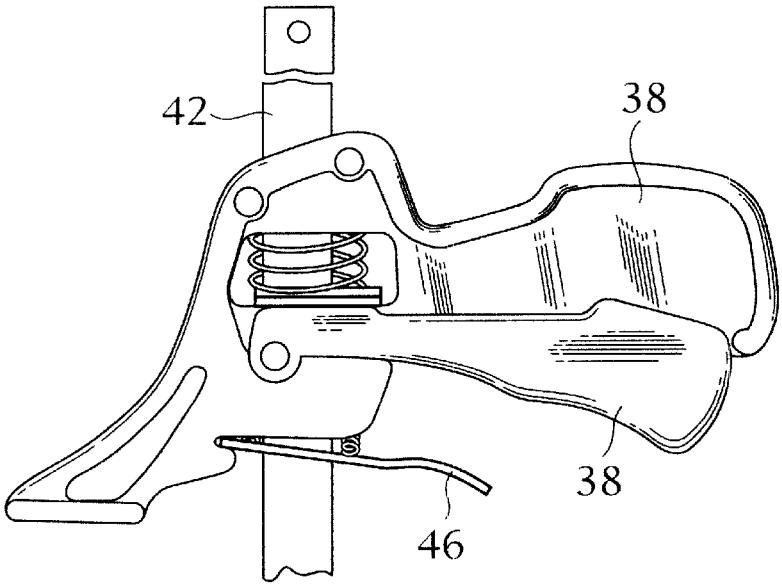
FIG. 7 is a cross-sectional view showing the ratcheting means of the jack system.
Figure 8:
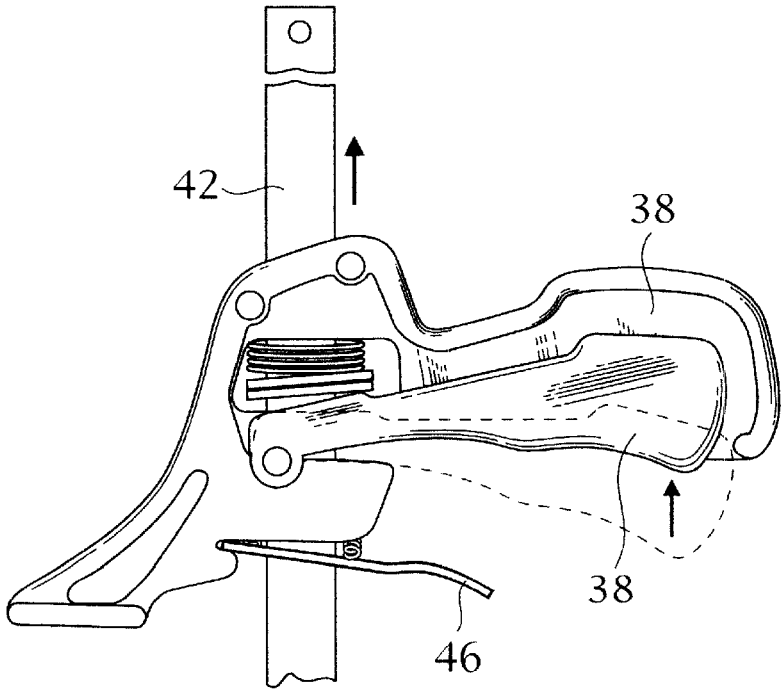
FIG. 8 is a view of FIG. 7 showing the handgrips compressed and the shaft advanced upwardly.
Figure 9:
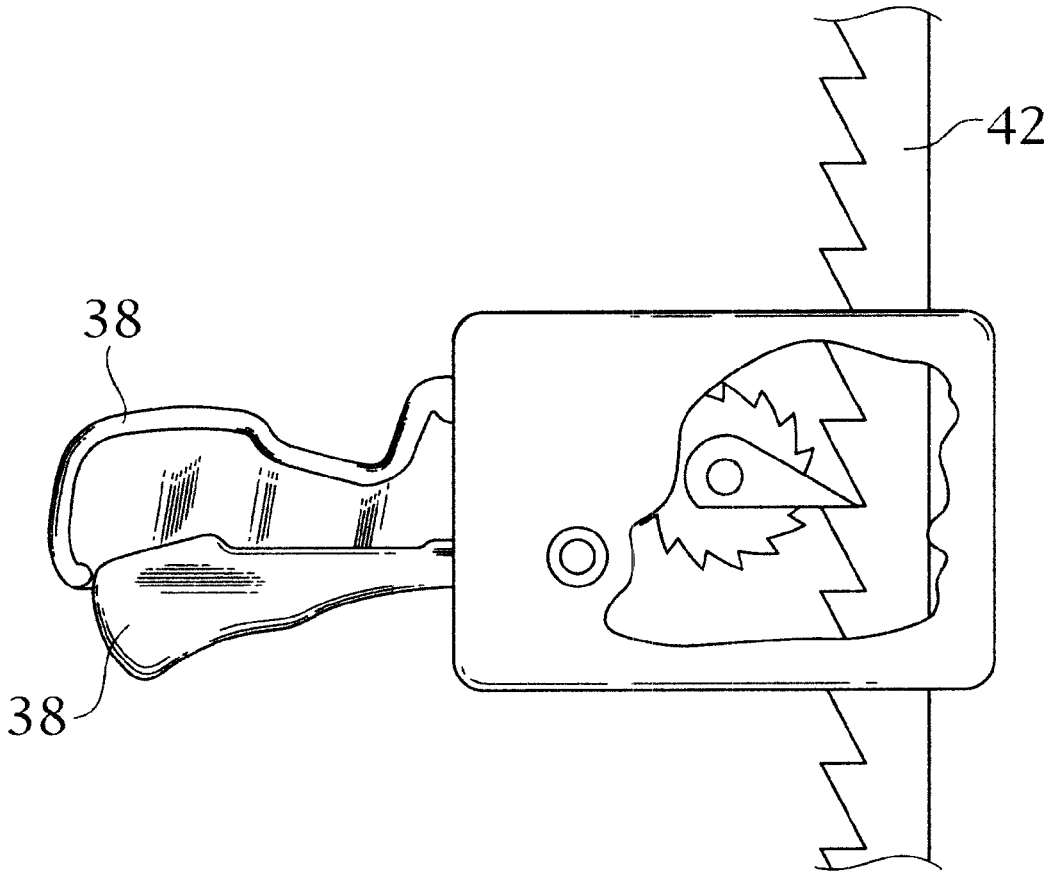
FIG. 9 is a partial cutaway view showing the jack system having a toothed ratcheting means.

A preferred jack system 24 is shown in FIG. 6 but the present invention is not limited to the jack system shown. Any jack system known to persons skilled in the art may be used. As shown in FIG. 6, a pair of hand grips 38 are connected between a frame 40 having two spaced-apart members. The hand grips 38 actuate a ratcheting means to advance a shaft 42 which extends above and below the hand grips 38 as shown in FIGS. 7 and 8. The ratcheting means which has been adapted and shown herein is similar to known ratcheting means as in U.S. Pat. No. 5,022,137. Other ratcheting means, including a pawl and teeth on the shaft 42 may be used (FIG. 9). A lock means 44 is connected to the hand grips 38 to prevent further movement when a desired setting is obtained. A quick release lever 46 is also attached to the hand grips 38 and the lock means 44 to release the ratcheting means and to provide rapid movement of the shaft 42 and the top pad 26 attached to the upper end of the shaft 42. The coarse adjustment of the jack system 24 is produced by manually raising the shaft 42 to place the top pad 26 adjacent to the ceiling 36. Fine adjustment of the jack system 24 is produced by manually squeezing the hand grips 38 to ratchet the top pad 26 against the ceiling 26 with a desired force. Pressing on the quick release lever 46 allows top pad 26 to fall away from the ceiling 36 due to the weight of the top pad 26 and the shaft 42. The frame 40 is so disposed that the shaft 42 is at an angle of approximately 10°–14° with respect to the planar rigid member 12 as discussed above.

At least one, and preferably two or more, horizontal braces 28 are mounted on the second face of the planar rigid member 12 and the vertical brace 20 is connected to the at least one horizontal brace 28 in an "H" frame configuration. These braces 20, 28 provide additional strength and support to the rigid member 12. Also, it is preferred that the at least one horizontal brace 28 be spaced apart from the second face of the planar rigid member 12 to provide a clearance for the user's hands to be received. In this manner, the user can lift and move the planar rigid member 12 by grasping the at least one horizontal brace 28.

Figure 10:
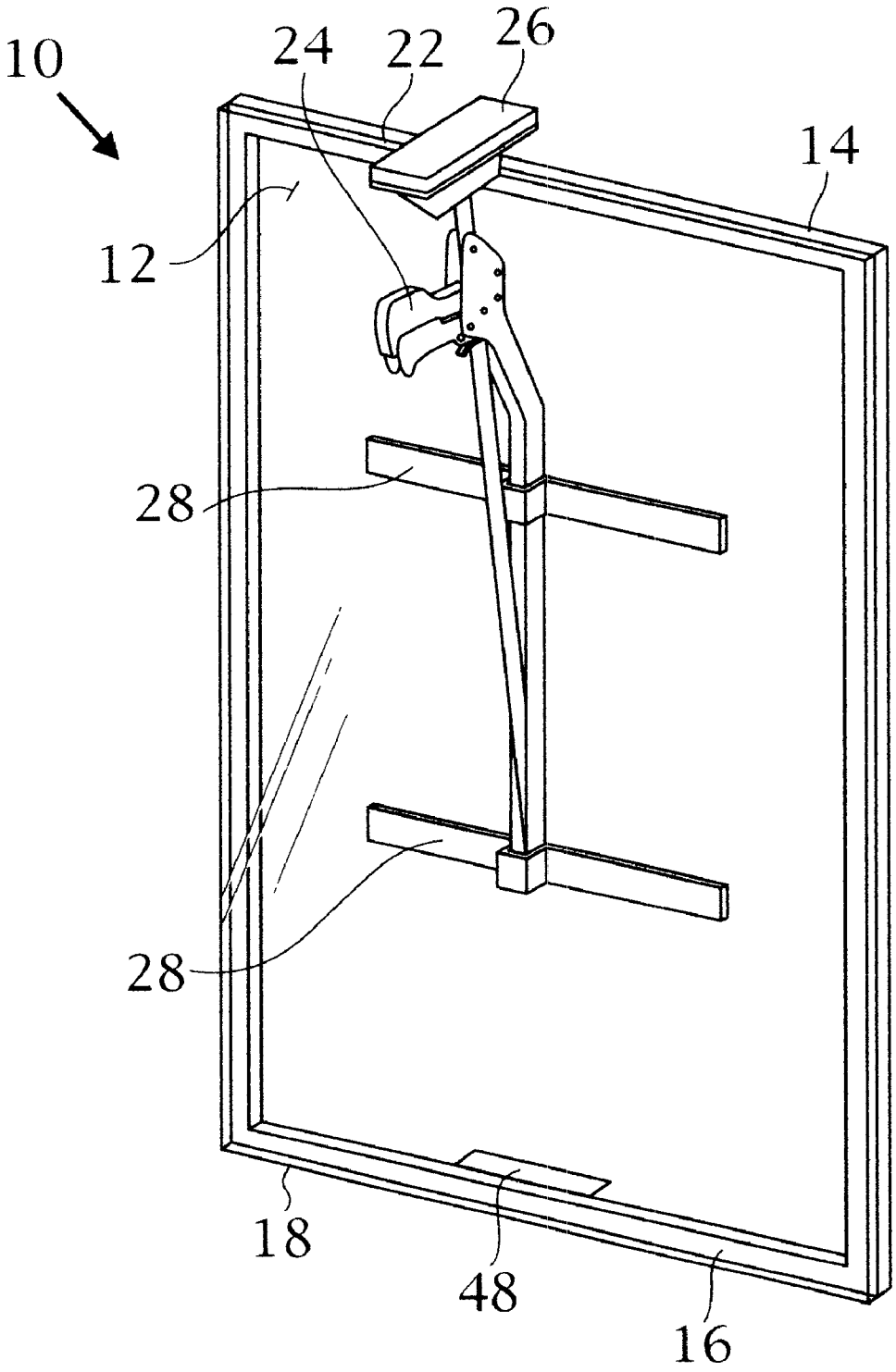
FIG. 10 is a perspective view of the apparatus showing another embodiment of the support braces.
Figure 11:
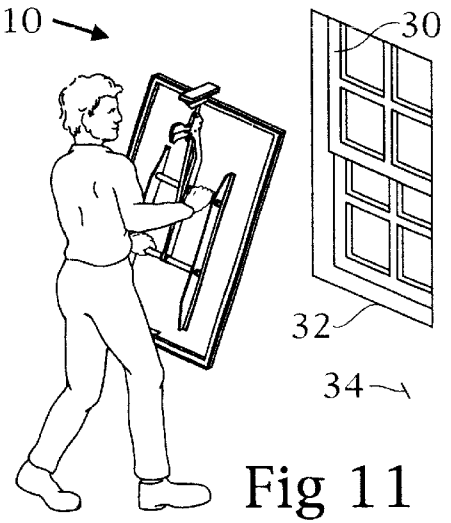
FIGS. 11–16 are a sequence showing the installation of the apparatus of the present invention and removal of the structure.
Figure 12:
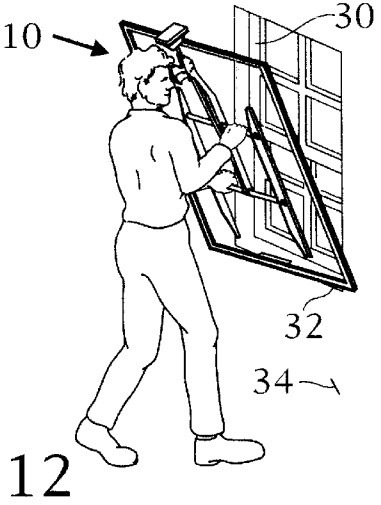
Figure 13:
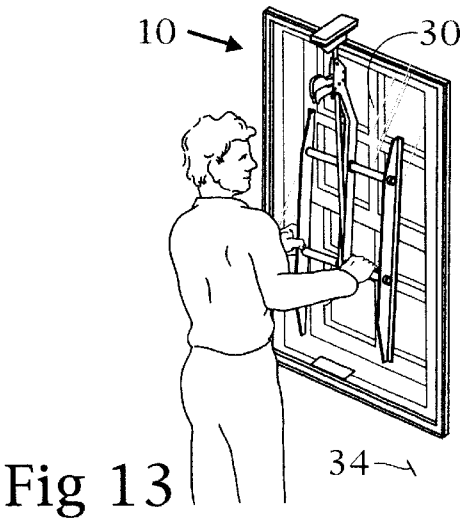
Figure 14:
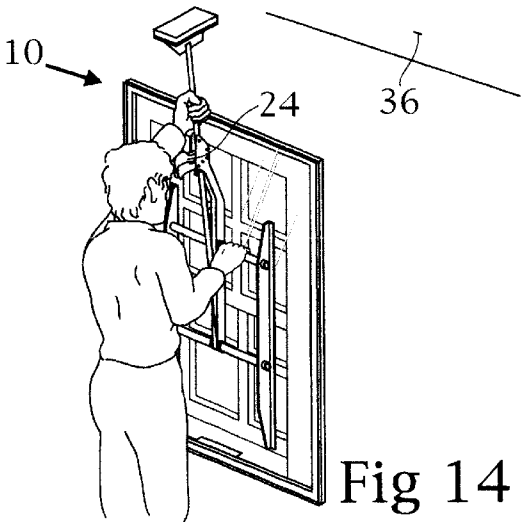
Figure 15:
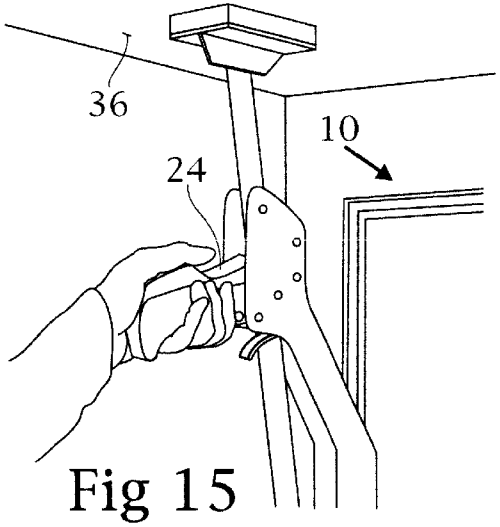

Alternately, the vertical brace 20 may be a single member to which is connected at least one, and preferably two, horizontal braces (FIG. 10). The at least one horizontal brace is connected to the rigid member 12.

The structure 30 is a window, window sash, window frame, door frame, wall or other portion of a building which is to be removed with minimum dust and debris entering the interior of the building. When the structure 30 is a window sash, window/window frame, there is a stool or sill 32 which is an interior horizontal ledge at the bottom of the window frame.

The present invention may be used in many situations. For example, many individual homeowners are upgrading the windows in their homes to install more high-quality energy-efficient windows. The present invention provides a means to rapidly remove the older windows without disrupting the routine of the homeowner. There is no need to move the furniture within the room, and there is no dirt or debris introduced into the residence when the old windows are removed.

As shown in FIGS. 11–16, the bottom end 18 of the rigid member 12 is placed on top of the stool 32 with the second gasket means 16 forming an airtight relationship or seal between the stool 32 and the bottom end 18 of the rigid member 12. While supported on the stool 32, the rigid member 12 is placed abutting a vertical surface such as a window trim or the wall 34 in which the structure 30 is located. The first gasket means 14 directly contacts the window trim or the wall 34 surrounding the structure and forms an airtight relationship with the window trim or the wall 34. The adjustable jack system 24 is adjusted to bring the top pad 26 in contact with the ceiling above the rigid member 12 and to maintain a minimum pressure against the rigid member 12 to assure the airtight relationship between the second gasket means 16 and the window stool 32. The adjustable supporting member 24 also serves to prevent movement of the rigid member in any other direction and assists in maintaining the airtight relationship of the first gasket means 14 with the wall 34.

Figure 16:
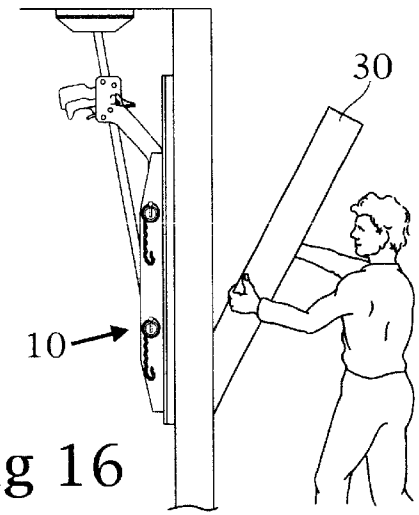

After the apparatus 10 is securely mounted interiorly in the building against the inside of the window trim or the wall 34, a worker outside of the building removes the structure 30 as shown in FIG. 16. All dust and debris are cleaned from the opening formed when the structure 30 is removed. If the structure 30 has a lead paint coating, the first face of the apparatus 10 is detoxified. The apparatus 10 is dismounted from the interior wall 34 and is available for subsequent reuse.

Figure 1:
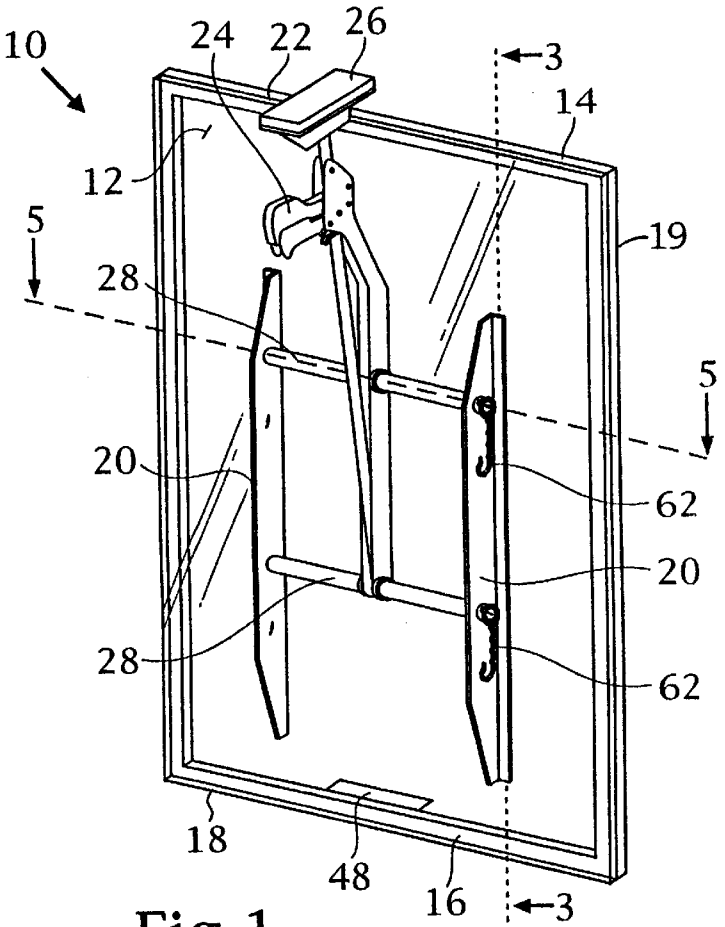
FIG. 1 is a perspective view of the apparatus of the present invention viewed from the face oriented opposite from the structure in the wall.
Figure 3:
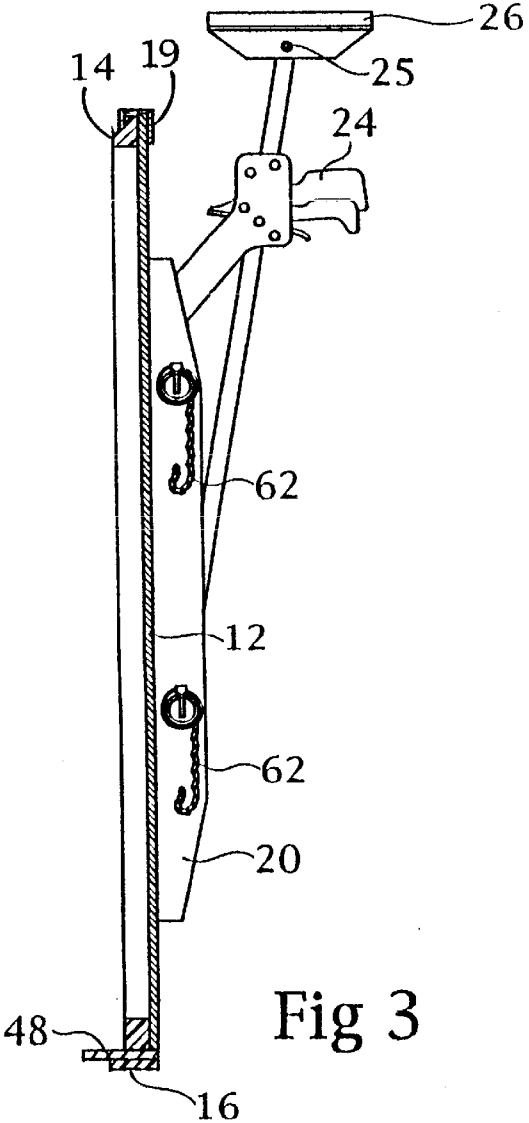
FIG. 3 is a cross-sectional view taken across the lines 3—3 of FIG. 1.
Figure 5:
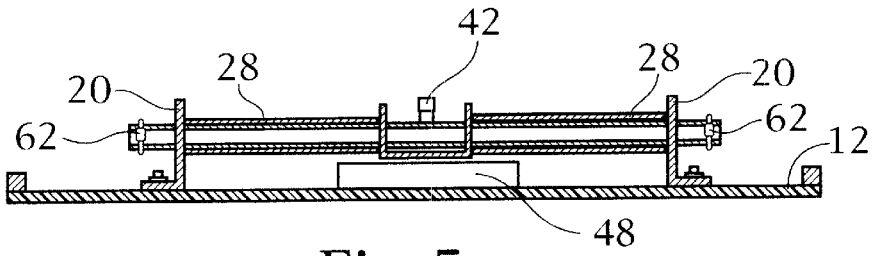
FIG. 5 is a cross-sectional view taken across the lines 5—5 of FIG. 1.

It is further preferred that an engaging means 48 be formed extending horizontally outwardly from the bottom end 18 of the rigid member 12 toward the polluted structure 30 (FIGS. 1–3). The engaging means 48 may extend the entire length of the bottom end 18 of the rigid member 12 or may extend only a portion of the length. The engaging means 48 may be a protruding ledge which is disposed on the window stool 32 to assist in supporting the apparatus 10.

Figure 17:
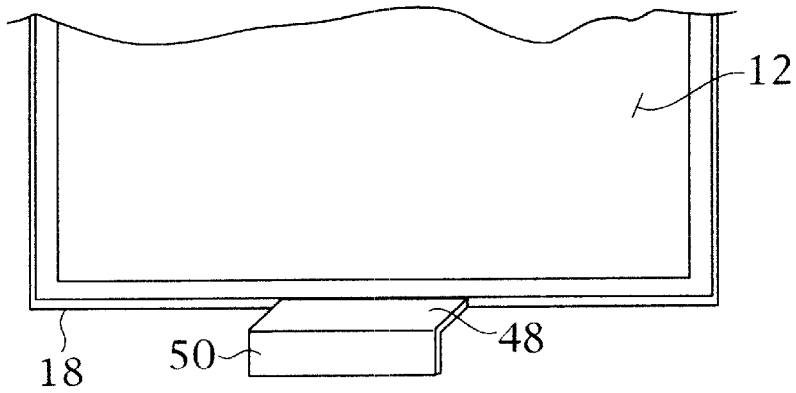
FIG. 17 is a perspective view of the bottom end of the rigid member showing an embodiment of the engaging means.
Figure 18:
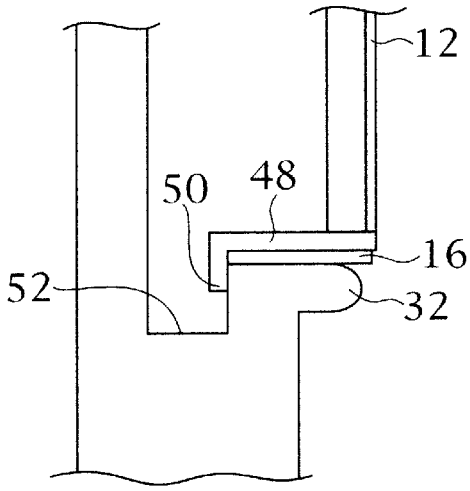
FIG. 18 is a side elevation view enlarged to show the bottom end of the rigid member on the window stool and the engaging means received in the well in the window frame.

In another embodiment (FIGS. 17–18), the engaging means 48 has a downwardly-depending portion 50 which engages a portion of the structure 30. When the structure 30 is a window/window frame, there is a well 52 formed in the window frame adjacent to the window stool 32. The downwardly-depending portion 50 of the engaging means 48 is received in the well 52 and assists in securing the bottom end 18 of the rigid member 12 to the structure 30.

Figure 19:
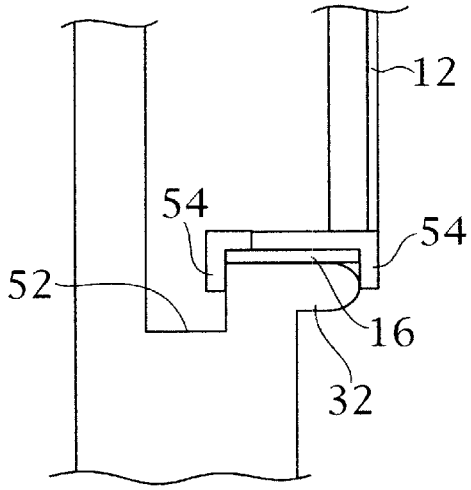
FIG. 19 is a side elevation view enlarged to show the bottom end of the rigid member on the window stool and a clamp-type engaging means on the stool.

In another embodiment (FIG. 19), the engaging means 48 is an adjustable clamp having two opposing jaws 54 wherein the window stool 32 is received between the jaws 54 and the jaws are moved to secure the bottom end 18 of the rigid member 12 to the window stool 32 of the structure 30. The jaws 54 are movable with respect to one another and may be manually slid to the desired engagement or may be connected to a threaded drive.

Figure 20:
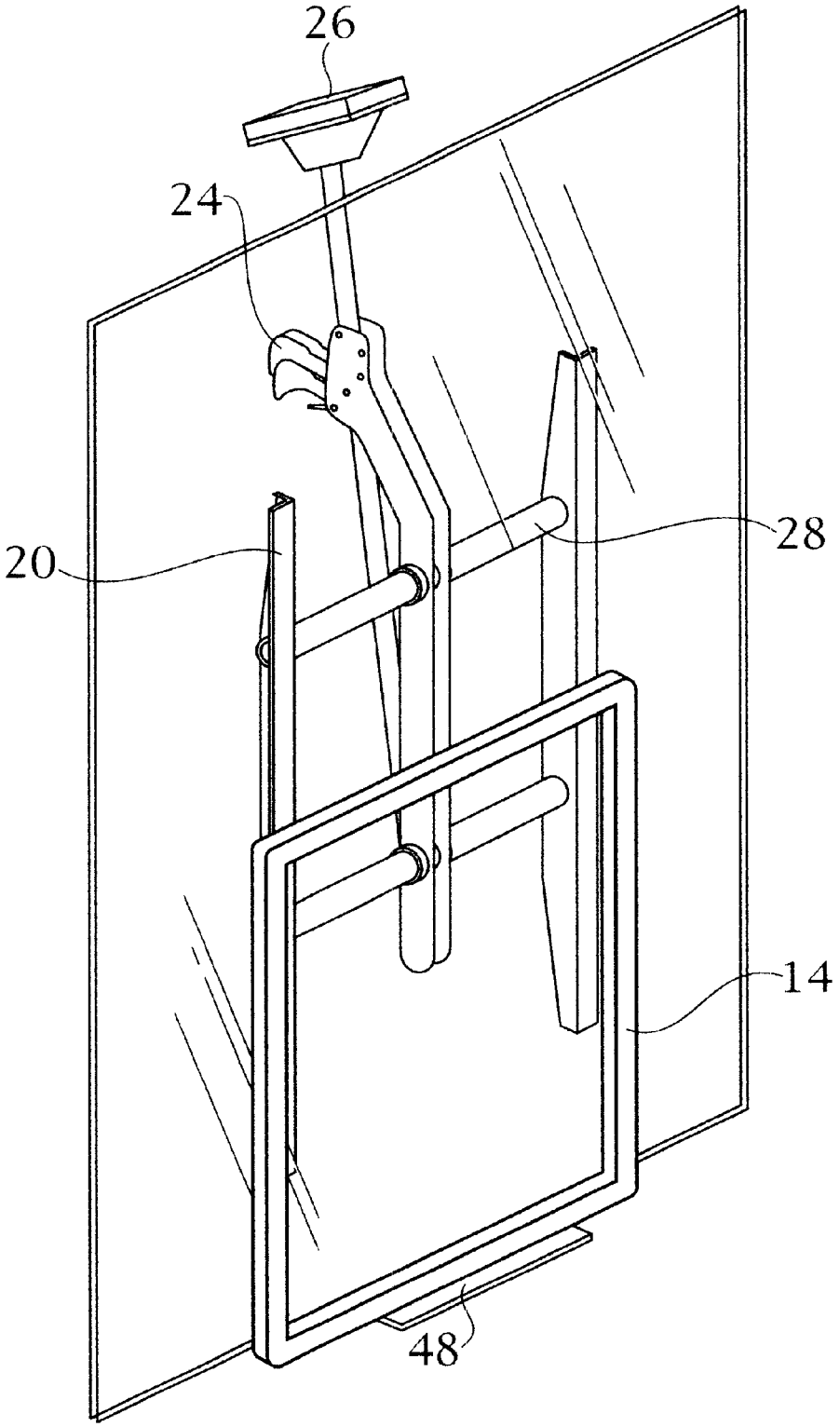
FIG. 20 is a perspective view of the apparatus viewed from the face oriented toward the surface showing the first gasket adapted to be used with a small structure.

The apparatus 10 may be formed having a rigid member of any desired dimensions to enable the apparatus to be used with larger or smaller structures. For example, a rigid member of approximately 40 inches wide and 56 inches high will be large enough to be used with a standard window. Two of the apparatuses 10 butted together with a gasket in between are used with adjacent windows. Also, for smaller windows or structures, as shown in FIG. 20, the first gasket means 14 may be moved or adapted to surround a smaller area. Alternately, the worker has a roll of gasketing material which can be adhered to the first face of the rigid member 12 to surround the smaller area.

Figure 21:
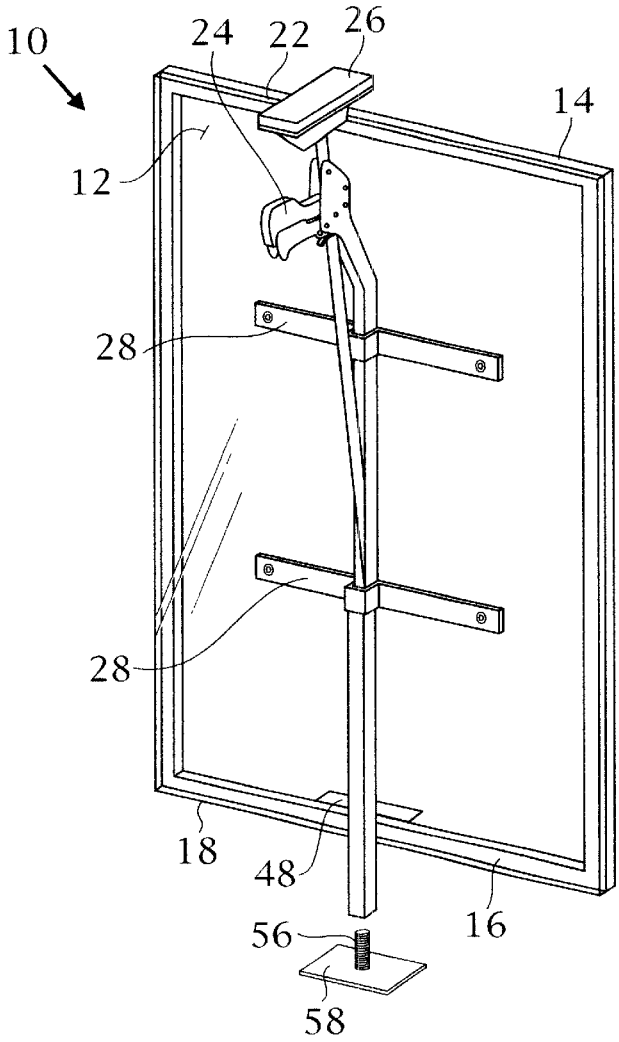
FIG. 21 is a perspective view of an embodiment having an adjustable extension which is extendable to provide support on the floor.

In another embodiment (FIG. 21), the vertical brace 20 is extended below the rigid member 12. An adjustment means 56 is provided to lengthen or shorten the portion of the vertical brace 20 below the rigid member such that a base 58 may engage a lower surface such as the floor inside the building. When this embodiment is used, the rigid member 12 is not supported on the stool of the window but is supported against the lower surface (floor). This embodiment may be preferred where the entire window frame is to be removed or where it is otherwise not possible to support the engaging means 48.

Thus, the present invention is a relatively lightweight device which one person can move and install in a building. The bottom end 18 of the rigid member 12 is supported on a portion of the structure 30 or on the floor with a second gasket means 16 forming an airtight seal. The apparatus 10 contacts the window trim or the wall 34 surrounding the structure and an airtight seal is formed between the window trim or the wall 34 and the first gasket means 14 on the first face of the rigid member 12. The engaging means 36 is engaged with the structure 30 or the member 12 may be supported against the lower surface or the floor. A vertical brace 20 is adjusted to contact the ceiling and exert force vertically on the bottom end of the rigid member 12 to ensure the seal of the second gasket means 16 and to exert force horizontally on the rigid member 12. The structure 30 is removed while working outside of the building. The area and the rigid member are detoxified if necessary, and the apparatus is removed and reused.

For ease of disassembly or for shipping of the apparatus 10, a through opening is formed near the ends of the horizontal braces 20 and a pin connected to one end of a chain 62 is inserted in the opening. The opposite end of the chain is connected to the vertical brace 20. The pins may be removed from the openings so that the horizontal braces 28 may be separated from the vertical braces 20 and the rigid member 12. This feature is not essential but makes the apparatus more versatile.

The apparatus 10 of the present invention can be installed by a single worker in approximately 5–10 minutes. There is very little inconvenience to occupants of the building when the apparatus 10 is used to remove structures contaminated with lead paint, and there are no portions of the apparatus which must be treated and disposed as contaminated waste. The apparatus is ready for reuse immediately after removal from a worksite.

Figure 22:
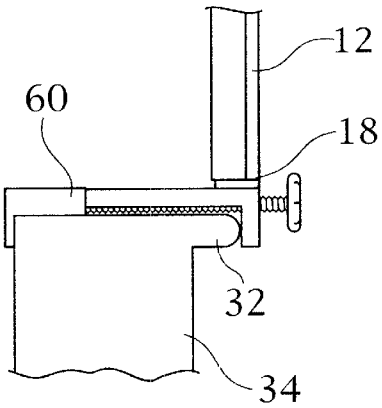
FIG. 22 is a cross-section view showing a clamp to support the bottom of the rigid member to the exterior of the building.

The apparatus of the present invention may be used when a window is broken or blown out due to weather extremes or vandalism. The apparatus is simply installed interiorly in the building over the window opening until a repair or replacement is made. There is no need to cover the window opening with plywood or similar material. The present invention, furthermore, is transparent so the interior is not dark and persons may look out through the apparatus. As shown in FIG. 22, a clamp means 60 may be formed on the bottom end 18 of the rigid member 12 to secure the present invention to the exterior of the wall 34 of the building in the event the window is broken or blown out. The clamp means 60 is adjustable to accommodate walls of varying thicknesses and to provide a means to secure the rigid member in place. It is possible for businesses, apartments and condominiums to maintain a supply of the rigid members which are specifically made for the window size and wall thickness of the particular building so that rapid protection can be afforded to the occupants of the building. This option is particularly useful in regions subject to hurricanes, tornados and weather extremes where the apparatus of the present invention will prevent the entry of water and wind in addition to dirt and debris. The rigid member may be made using a -bullet-proof material for situations where security is required.

Figure 23:
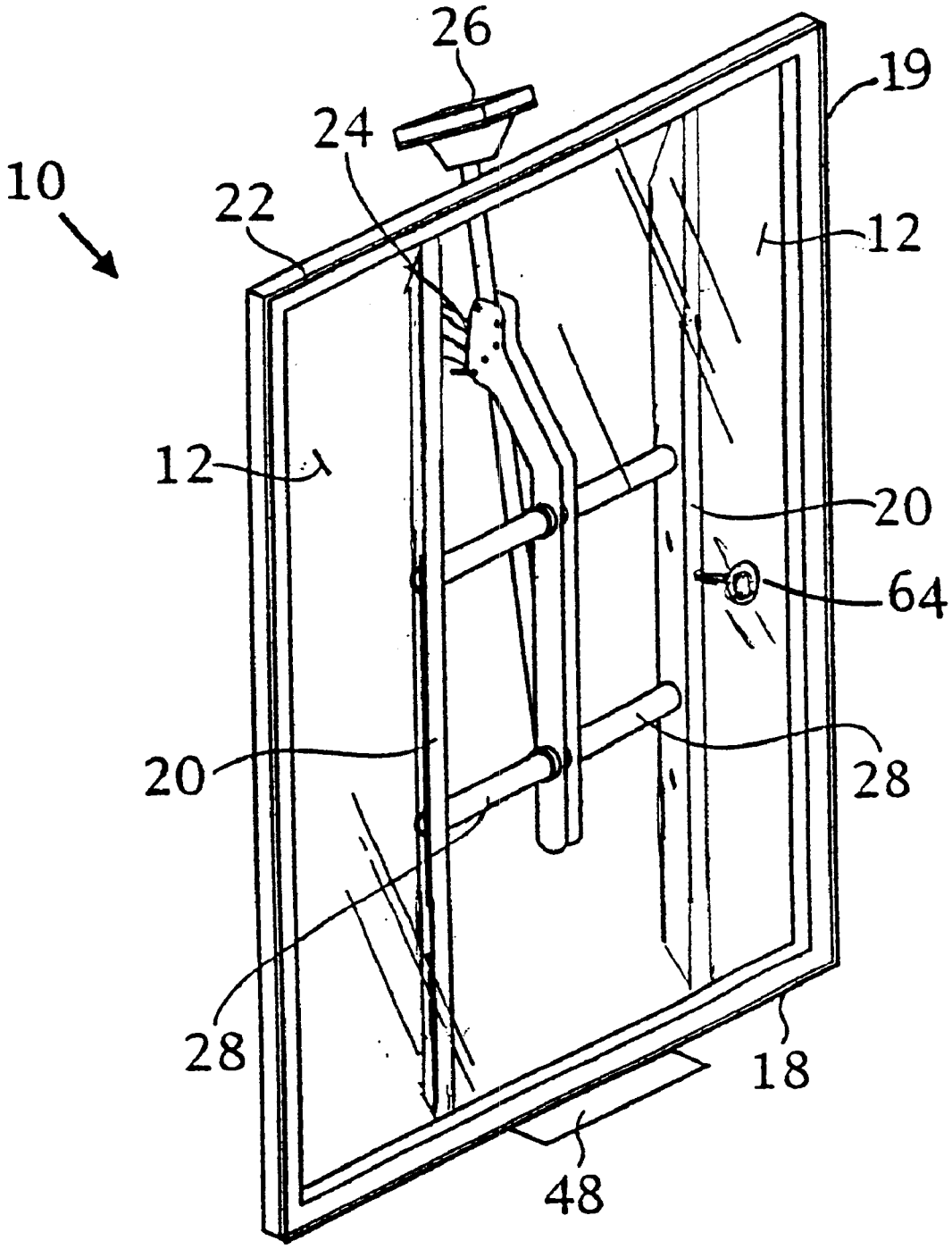
FIG. 23 is a perspective view from the face oriented toward the structure in the wall showing an eye bolt for a safety line for workman.

As shown in FIG. 23, the vertical braces 20 extend the entire height of the rigid member 12. at least one eye bolt 64 is mounted in at least one of the vertical braces such that the stem of the eye bolt 64 extends through the rigid member 12 with the eye portion projecting outwardly from the face of the rigid member toward the exterior of the building. A seal is formed on the rigid member around the stem. In this manner, when the rigid member is installed within the building, a workman may connect a safety belt to the eye bolt 64 to prevent the workman from falling. In the event of a fall, the workman's weight would be supported by the vertical braces 20 which contact the internal wall above and below the opening in the wall.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a building including an interior having an upper surface and a lower surface, vertically spaced apart, and further having a structure in a wall disposed vertically between the upper surface and the lower surface, an apparatus for removing the structure from externally of the building, the apparatus comprising:

a single unitary planar rigid member adapted to fit against a vertical surface within the interior of the building and to surround the structure in a substantially airtight relationship, thereby precluding dust and debris from entering the interior of the building as the structure is removed from externally of the building, the rigid member having a top end and a bottom end, the bottom end being supported on a bottom portion of the structure, an adjustable supporting member connected to the rigid member and extending angularly to the upper surface above the top end of the rigid member, a first sealing gasket being disposed peripherally around the rigid member and surrounding the structure, forming the airtight relationship with the vertical surface, and a second sealing gasket being disposed on the bottom end of the rigid member forming the airtight relationship with the bottom portion of the structure.

2. The apparatus of claim 1, wherein the first gasket is movable to surround the structure.

3. The apparatus of claim 1, further comprising a vertical brace mounted on a face of the rigid member opposite from the structure, the adjustable supporting member being connected to the vertical brace.

4. The apparatus of claim 1 further comprising at least one horizontal brace mounted on a face of the rigid member opposite from the structure.

5. The apparatus of claim 1, wherein the structure is at least one window sash disposed in a window frame in the wall, the window frame having an interior stool on the bottom portion thereof, the bottom end of the rigid member being supported on the interior stool and the second sealing gasket being between the bottom end of the rigid member and the interior stool.

6. The apparatus of claim 1, wherein the rigid member is formed from a transparent material.

7. The apparatus of claim 1, wherein the adjustable supporting member is mounted at an angle of approximately 12±2° with respect to the rigid member.

8. The apparatus of claim 1, wherein a pad is disposed on the adjustable supporting member, the adjustable supporting member being movable to bring the pad in contact with the upper surface.

9. The apparatus of claim 1, wherein the vertical surface is the wall.

10. The apparatus of claim 1, wherein the vertical surface is a window trim.

11. The apparatus of claim 1, wherein the adjustable supporting member has a coarse adjustment and a fine adjustment.

12. In a building including an interior having an upper surface and a lower surface, vertically spaced apart, and further having a structure in a wall disposed vertically between the upper surface and the lower surface, an apparatus for removing the structure from externally of the building, the apparatus comprising:

a single unitary planar rigid member adapted to fit against a vertical surface within the interior of the building and to surround the structure in a substantially airtight relationship, thereby precluding dust and debris from entering the interior of the building as the structure is removed from externally of the building, the rigid member having a top end and a bottom end, the bottom end being supported on a bottom portion of the structure, an adjustable supporting member connected to the rigid member and extending angularly to the upper surface above the top end of the rigid member, a first sealing gasket being disposed peripherally around the rigid member and surrounding the structure, forming the airtight relationship with the vertical surface, and a second sealing gasket being disposed on the bottom end of the rigid member forming the airtight relationship with the bottom portion of the structure, further comprising an engaging means extending horizontally outwardly from the bottom end of the rigid member toward the structure and engaging the structure, wherein the bottom end of the rigid member is supported on the structure and the airtight relationship is maintained.

13. The apparatus of claim 12, wherein the engaging means is a protruding ledge.

14. The apparatus of claim 12, wherein the engaging means is an adjustable clamp.

15. In a building including an interior having an upper surface and a lower surface, vertically spaced apart, and further having a structure in a wall disposed vertically between the upper surface and the lower surface, an apparatus for removing the structure from externally of the building, the apparatus comprising:

a single unitary planar rigid member adapted to fit against a vertical surface within the interior of the building and to surround the structure in a substantially airtight relationship, thereby precluding dust and debris from entering the interior of the building as the structure is removed from externally of the building, the rigid member having a top end and a bottom end, the bottom end being supported on a bottom portion of the structure, an adjustable supporting member connected to the rigid member and extending angularly to the upper surface above the top end of the rigid member, a first sealing gasket being disposed peripherally around the rigid member and surrounding the structure, forming the airtight relationship with the vertical surface, and a second sealing gasket being disposed on the bottom end of the rigid member forming the airtight relationship with the bottom portion of the structure, wherein the structure is at least one window sash disposed in a window frame in the wall, the window frame having an interior stool on the bottom portion thereof, the bottom end of the rigid member being supported on the interior stool and the second sealing gasket being between the bottom end of the rigid member and the interior stool, wherein a well is formed in the window frame adjacent to the interior stool, an engagement means extending from the bottom end of the rigid member, the engagement means having a downwardly-depending portion which is received in the well thereby securing the bottom end of the rigid member to the structure.

16. In a building including an interior having a floor and a ceiling, and further having a structure in a wall disposed vertically between the floor and ceiling, an apparatus for removing the structure from externally of the building, the apparatus comprising:

a single unitary planar rigid member adapted to fit against a vertical surface within the interior of the building and to surround the structure in a substantially airtight relationship, thereby precluding dust and debris from entering the interior of the building as the structure is removed from externally of the building, an adjustable clamp means attached to a bottom end of the rigid member to prevent lateral movement of the bottom end of the rigid member to secure the bottom end of the rigid member to the structure in the substantially airtight relationship, and an adjustable supporting member connected to the rigid member and extending angularly to a surface above a top end of the rigid member.

17. The apparatus of claim 16, wherein the clamp means are a pair of opposed surfaces movable with respect to one another, the opposed surfaces extending downwardly from the bottom end of the unitary member and engaging therebetween a portion of the structure.

18. The apparatus of claim 16, wherein the structure is a window and a window frame disposed in the wall, the window frame having an interior window stool, the bottom end of the unitary member being supported on the interior stool, the opposed surfaces of the clamping means being disposed on opposite sides of the window stool and being movable to clamp the window stool therebetween.

19. The apparatus of claim 16, wherein the single unitary planar rigid member has a face oriented toward the structure, a gasket disposed about a circumference of the single unitary rigid member and forming an airtight relationship with the vertical surface surrounding the structure.

20. The apparatus of claim 16, wherein a seal is formed between the bottom end of unitary rigid member and structure.

21. A containment apparatus for the removal of a window and/or window frame within the wall of a building, comprising a member disposed against a vertical surface from the inside of the building in sealing engagement therewith and covering the window and/or window frame, a jack carried by the member for rigidly retaining the member against the vertical surface within the building, such that the window and/or window frame may be removed from the outside of the building without dust or debris entering into the interior of the building, and the jack being angled with respect to the member, such that the jack exerts a force having a vertical component for retaining the jack within the building and further having a horizontal component for pressing the member against the vertical surface within the building.

22. The containment apparatus of claim 21, wherein the member comprises a substantially-flat sheet of high-impact transparent plastic material.

23. The containment apparatus of claim 22, further including a peripheral gasket carried by the sheet and for sealing engagement with the vertical surface within the building.

24. The containment apparatus of claim 21, wherein the building has a floor and a ceiling, and wherein the jack is disposed vertically between the floor and the ceiling of the building.

25. The containment apparatus of claim 21, wherein the building has a ceiling and the window frame has a sill, and wherein the jack is disposed vertically between the sill and the ceiling.

26. The containment apparatus of claim 21, wherein the window and/or window frame contains a lead-based paint, and wherein the containment apparatus prevents the interior of the building from being contaminated as the window and/or window frame is removed.

27. The containment apparatus of claim 21, wherein the jack is at an angle of approximately 12±2° with respect to the member.

28. The containment apparatus of claim 27, wherein the jack system is. angled with respect to the sheet, such that the jack exerts a force having a vertical component for retaining the jack within the building and further having a horizontal component for pressing the sheet against the vertical surface of the building.

29. The containment apparatus of claim 28, wherein the building has a floor and a ceiling, and wherein the jack system is disposed vertically between the floor and the ceiling of the building.

30. The containment apparatus of claim 28, wherein the building has a ceiling and the window frame has a sill, and wherein the jack system is disposed vertically between the sill and the ceiling.

31. The containment apparatus of claim 28, wherein the window and/or window frame contains a lead-based paint, and wherein the containment apparatus prevents the interior of the building from being contaminated as the window and/or window frame is removed.

32. A containment apparatus for the removal of a window and/or window frame within the wall of a building, comprising a substantially-flat sheet formed from a relatively high-impact plastic material and having a peripheral gasket for sealing engagement with a vertical surface of the building from the inside thereof, such that the sheet covers the window or window frame, and a means for removably retaining the sheet rigidly against the vertical surface of the building while the window or window frame is being removed externally of the building, thereby preventing dust or debris from entering into the building during removal of the window or window frame, further comprising at least one vertical brace mounted on a face of the sheet opposite from the vertical surface of the building, at least one eye bolt having a stem, and an eye portion, the stem of the at least one eye bolt extending through the sheet and being connected to the at least one vertical brace, and the eye portion protruding from the sheet oriented outwardly from the wall of the building.

33. In a building having a room having a ceiling and a window mounted in an opening between an exterior wall and an interior wall of the building wherein the window is blown out due to weather or is otherwise damaged, a temporary containment apparatus to enclose the opening comprising:

a substantially flat rigid member having a peripheral gasket for sealing engagement with the interior wall of the building wherein the rigid member completely covers the opening in the interior wall, the rigid member having a top end and a bottom end, an adjustable supporting member connected to the rigid member and extending angularly to the ceiling above the top end of the rigid member, an adjustable clamping means connected to the bottom end of the rigid member, wherein the clamping means is disposed in the opening between the exterior wall and the interior wall of the building to secure the rigid member.

34. In the method of removing a structure from a wall in a building, the improvement comprising the steps of providing a planar rigid member having a gasketing means formed peripherally thereabout, removably installing the planar rigid member within the building against the inside of a vertical surface, a bottom end of the planar rigid member being supported on a bottom portion of the structure being removed, the gasketing means on the planar rigid member contacting the vertical surface surrounding said structure in a substantially airtight manner, thereby confining any dust and debris and preventing the dust and debris from entering the building, removing the structure while working from outside of the building, and removing the planar rigid member for subsequent reuse thereof, wherein the planar rigid member has an engaging means extending horizontally outwardly from the bottom end of the planar rigid member toward the structure being removed, and installing the rigid member wherein the engaging means engages the structure.

35. The method of claim 36, wherein a jack system is carried by the rigid member at an angle thereto, adjusting the jack system to engage the building to secure the planar rigid member within the building.

* * * * *